United States Patent [19]

Jürgens

[11] Patent Number: 5,038,873

[45] Date of Patent: Aug. 13, 1991

[54] DRILLING TOOL WITH RETRACTABLE PILOT DRILLING UNIT

[75] Inventor: Rainer Jürgens, Celle, Fed. Rep. of Germany

[73] Assignee: Baker Hughes Incorporated, Houston, Tex.

[21] Appl. No.: 523,702

[22] Filed: Apr. 12, 1990

[30] Foreign Application Priority Data

Apr. 13, 1989 [DE] Fed. Rep. of Germany ..... 3912067

[51] Int. Cl.[5] ..... E21B 25/04

[52] U.S. Cl. ..... 175/246; 175/250; 175/257; 175/387

[58] Field of Search ..... 175/249, 246, 250, 251, 175/252, 257, 386, 387

[56] References Cited

U.S. PATENT DOCUMENTS 2,910,273 10/1959 Bon ..... 175/246
2,944,792 7/1960 Gros ..... 175/246
4,518,050 5/1985 Sollie et al. ..... 175/250
4,875,531 10/1989 Biehl et al. ..... 175/250

*Primary Examiner*—Terry Lee Melius
*Attorney, Agent, or Firm*—Joseph A. Walkowski; Michael Polacek

[57] ABSTRACT

The present invention comprises a drilling tool including a retractable pilot drilling unit driven by a fluid operated motor, the motor comprising a stator mounted on the interior of a tubular outer housing and a rotor mounted on the exterior of a tubular inner housing axially supported in said outer housing and rotationally free with respect thereto. The pilot drilling unit is rotationally fixed within the inner housing, but axially moveable therewithin so that pressure of drilling fluid used to drive the motor will also act on reaction surfaces of the pilot drilling unit to urge it axially forward. The top of the pilot drilling unit includes a fishing head for retracting the pilot drilling unit from the drilling tool, and reinserting it therein.

8 Claims, 1 Drawing Sheet

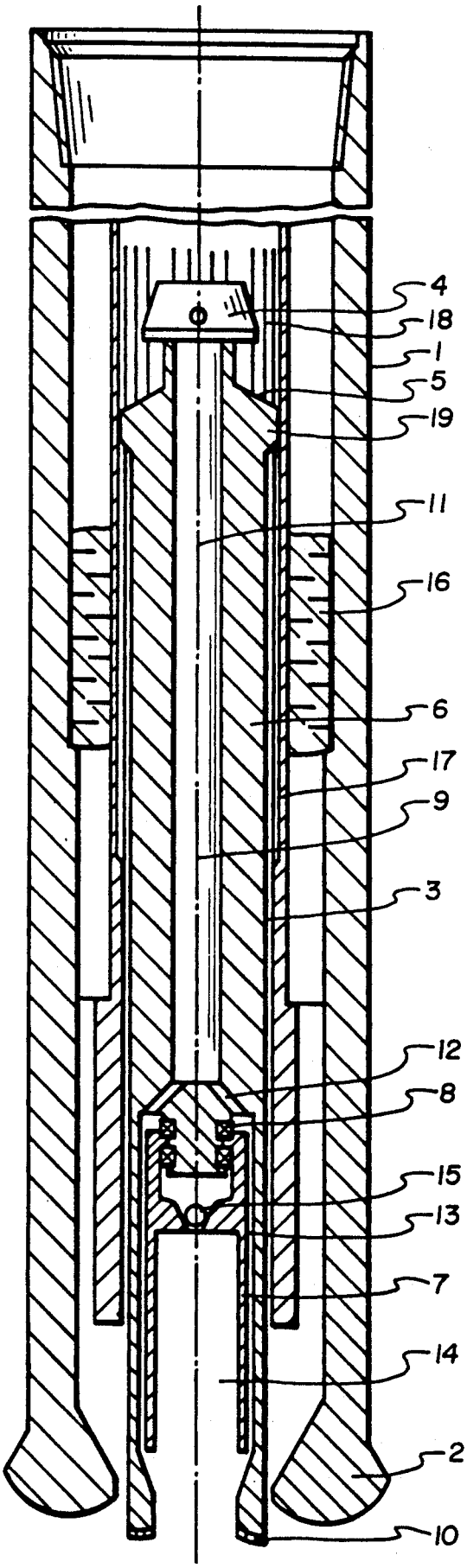
4
18
1
5
19
11
16
6
17
9
3
12
8
15
13
7
14
2
10

DRILLING TOOL WITH RETRACTABLE PILOT DRILLING UNIT

BACKGROUND OF THE INVENTION

With a known drilling tool of this type as disclosed in U.S. Pat. No. 4,875,531 for drilling pilot cores, the deep well drilling motor to drive the core barrel of the core drilling unit is designed as a Moineau motor and is a retractable part of the core drilling unit. The stator of the deep well drilling motor is supported so it can move axially but cannot rotate in the longitudinal guides of the outer casing, and the core barrel of the core drilling unit is rotationally mounted in the lower end area of the stator of the deep well drilling motor and is connected to the output shaft of the deep drilling motor. A similar drilling tool is described in U.S. Pat. No. 4,518,050, where a turbine that forms a component of the retractable core drilling unit is provided as the drilling motor.

SUMMARY OF THE INVENTION

This invention is responsive to the problem of creating a drilling tool, the pilot drilling unit of which can be driven at an especially high power.

The design of the drilling tool according to this invention creates an extremely simple pilot drilling unit which consists essentially only of a barrel body with a fishing head mounted on its upper end and, if the unit is a coring unit, an optional inner tube mounted so it can rotate freely in the lower part of the barrel. The pilot drilling unit is retractably mounted within a tubular inner housing inside the outer housing. The turbine motor disposed between the inner and outer housings of the drilling tool can be constructed with a much larger diameter thanks to this arrangement and can therefore be designed for much higher powers and speeds so the pilot drilling tool according to this invention is especially suitable for core drilling jobs in hard rock.

BRIEF DESCRIPTION OF THE DRAWING

With regard to additional details, reference is made to the following description and the drawing FIGURE which shows a schematic cutaway cross section of one example of the invention.

DETAILED DESCRIPTION OF THE PREFERRED EMBODIMENTS

The drilling tool as illustrated includes a tubular outer housing 1 which can be connected at its upper end to a string of drill pipe by means of fittings, especially a screw thread. The string of drill pipe can be driven by means of an above-ground drive, e.g., the turntable of a drill rig, in a known way wherein it can also be stopped and secured against rotation in a predetermined position.

At its lower end, outer housing 1 can have a coring type drill crown 2 which may be of any known or suitable design. This drill crown 2 or bit can be eliminated in certain cases such as when a special drilling tool is used, e.g., a drilling tool for underreaming or reboring the hole from the diameter of a precut pilot bore to the main bore diameter, or when bore opening work is eliminated as in the case of ocean floor exploration.

The drilling tool shown here also includes a core drilling unit 3 as the pilot drilling unit which can be retracted out of and lowered into the exterior housing 1 by means of a fishing head 4 provided at its upper end. Core drilling unit 3 can also move axially with respect to exterior housing 1 during the core drilling operation.

Core drilling unit 3 has reaction faces 5 that are exposed to the pressure of the drilling fluid during the core drilling operation in order to produce an axial forward thrusting force acting on the core drilling unit 3. Core drilling unit 3 includes a core barrel 6 as well as an inner tube 7 that is mounted in a lower cavity of core barrel 6 by means of a bearing device 8 so it can rotate freely with respect to the central longitudinal axis 9 of the drilling tool to receive a core that has been drilled. Core barrel 6 has its own coring drill bit 10 at the lower end and has an axial flow channel 11 which leads to branches 12 above the bearing device 8 and opens into a flow gap 13 between core barrel 6 and inner tube 7. At the upper end of core receiving chamber 14 in the inner tube 7, core drilling unit 3 is provided with a check valve 15 which opens when core drilling unit 3 enters a borehole and permits an upward flow of drilling fluid in the drill string and the drilling tool as is known in the art.

Instead of this embodiment, pilot drilling unit 3 may also have a barrel body provided with fishing head 4 and designed as the carrier of a drilling tool to drill a full uncored pilot bore which is optionally used with the core barrel design, e.g., for alternating core drilling and complete drilling jobs.

The drilling tool also includes a drilling motor that is operated with drilling mud and is designed as a drilling fluid driven turbine 16, where outside housing 1 carries the stator of a turbine 16 in its interior and a tubular inside housing rotatably mounted and axially supported in outside housing 1 carries the rotor of turbine 16 on its interior. The inner housing 17 that carries the rotor of the turbine 16 is provided with axially oriented longitudinal guides 18 on its inside by means of which the core drilling unit is supported so it can move axially but not rotationally in operation. Longitudinal guides 18, which are preferably formed by a profile with multiple grooves, are engaged with wedge areas 19 at the circumference of the upper end of core barrel 6, so that when turbine 16 is operated it drives (rotates) core barrel 6 directly.

In the design of the core body as a core barrel as well as in the design as a complete drill bit carrier, extensions can be inserted into the body of barrel 6 below the area of engagement at wedge area 19 with the inner housing 17 in order to increase the pilot drilling distance beyond the main well bore.

Due to the arrangement of turbine 16 relative to outside housing 1, turbine 16 can be constructed with a relatively large diameter and can be designed for an especially high power and high speeds accordingly. During operation of turbine 16 for pilot drilling with the help of the pilot drilling unit which is shifted progressively downward in the outside housing 1, outside housing 1 can be stopped or it may execute its own rotation by means of the above-ground drive by way of the string of drill pipe. In the latter instance, it is possible to begin opening the borehole in suitable formations shortly after a pilot core has been started and before it is concluded.

In pilot core drilling, the core drilling unit 3 is retracted together with the core contained in the receiving chamber 14 of inner tube 7 after cutting the core and is inserted again after the core has been removed above ground into the inner housing 17 of the drilling tool which carries the inside rotor of turbine 16. During the process of retracting and lowering core drilling unit 3, the pilot core hole can be opened to the full bore of drill crown 2 as far as the bottom thereof.

However, even in cases when it is not necessary to open pilot holes, e.g., in investigations of ocean bottoms where outside housing 1 is used without a separate drill bit and can be placed with its lower end on the ocean bottoms, the linkup between the turbine and the outside casing 1 is important not only for power reasons but also in order to position the drive close to the pilot drilling unit—more or less in the sense of a drilling platform that is advanced to a position close to the bottom of the wellbore, especially useful at great water depths, and when using pilot barrels of great lengths incorporating extensions.

While the present invention has been described in terms of preferred embodiments, it will be apparent to one of ordinary skill in the art that many additions, deletions and modifications thereto may be made without departing from the spirit and scope of the claimed invention.

I claim:

1. A drilling tool for pilot drilling a subterranean formation, comprising:

a tubular outer housing having means at the upper end thereof for connection to a drill pipe string and containing a stator of a fluid operated drilling motor;

a tubular inner housing axially supported in said outer housing and rotationally free with respect thereto carrying a rotor of a fluid operated drilling motor on the exterior thereof; and a pilot drilling unit axially disposable in and retractable from the interior of said inner housing and including a reaction surface at the top thereof for producing an axially forwardly directed force on said pilot drilling unit in response to flow of drilling fluid to said motor and a drill bit at the bottom thereof, said pilot drilling unit and said inner housing including mutually engageable means for preventing rotation of said pilot drilling unit within said inner housing while permitting axial movement of said pilot drilling unit therewithin.

2. The drilling tool of claim 1, wherein said pilot drilling unit includes a fishing head at the top thereof.

3. The drilling tool of claim 1, wherein said pilot drilling unit is a core drilling unit.

4. The drilling tool of claim 3, wherein the core drilling unit includes:

a core barrel;

a core bit at the lower end of the core barrel;

an inner tube rotationally disposed within the core barrel for receiving a core.

5. The drilling tool of claim 1, wherein said pilot drilling unit includes a drill bit at its lower end.

6. The drilling tool of claim 1, wherein said pilot drilling unit includes means for extending the length of the pilot hole.

7. The drilling tool of claim 1, wherein said outer housing includes a core bit at its lower end.

8. The drilling tool of claim 1, wherein said motor comprises a turbine.

* * * * *